US007313999B2

(12) United States Patent
Shimizu et al.

(10) Patent No.: US 7,313,999 B2
(45) Date of Patent: Jan. 1, 2008

(54) PISTON FOR A RECIPROCATING MACHINE

(75) Inventors: Shigemi Shimizu, Isesaki (JP); Masatoshi Sagiya, Isesaki (JP); Hidenori Hosoi, Isesaki (JP)

(73) Assignee: Sanden Corporation, Gunma (JP)

( * ) Notice: Subject to any disclaimer, the term of this patent is extended or adjusted under 35 U.S.C. 154(b) by 597 days.

(21) Appl. No.: 10/898,175

(22) Filed: Jul. 26, 2004

(65) Prior Publication Data

US 2005/0025648 A1 Feb. 3, 2005

(30) Foreign Application Priority Data

Aug. 1, 2003 (JP) ..... 2003-284887
Dec. 25, 2003 (JP) ..... 2003-430814

(51) Int. Cl.
*F04B 27/00* (2006.01)
*F04B 1/12* (2006.01)

(52) U.S. Cl. ..... 92/177; 92/165 R

(58) Field of Classification Search ..... 92/71, 92/165 R, 177; 91/499; 417/269
See application file for complete search history.

(56) References Cited

U.S. PATENT DOCUMENTS 5,380,166 A * 1/1995 Terauchi ..... 92/177
5,421,243 A * 6/1995 Burkett et al. ..... 92/177
7,131,822 B2 * 11/2006 Shiina ..... 92/165 R

FOREIGN PATENT DOCUMENTS

JP 06346844 12/1994

* cited by examiner

*Primary Examiner*—Thomas E. Lazo
(74) *Attorney, Agent, or Firm*—Baker Botts L.L.P.

(57) ABSTRACT

A piston includes a piston body fitted into a cylinder bore and having a sliding peripheral surface disposed in sliding contact with the inner peripheral surface of the cylinder bore. The sliding peripheral surface of the piston body and the inner peripheral surface of the cylinder bore each have a noncircular cross-sectional form. The sliding peripheral surface of the piston body is formed by an elastically deformable sealing member.

9 Claims, 10 Drawing Sheets

PISTON FOR A RECIPROCATING MACHINE

This nonprovisional application claims priority under 35 U.S.C. 119(a) on Patent Application No. 2003-284887 filed in Japan on Aug. 1, 2003 and Patent Application No. 2003-430814 filed in Japan on Dec. 25, 2003, the entire contents of which are incorporated herein by reference.

BACKGROUND OF THE INVENTION

1. Field of the Invention

The present invention relates to a piston for a reciprocating machine and to a reciprocating machine using the piston.

2. Description of the Related Art

Reciprocating machines include a swash plate compressor, and this type of compressor is disclosed, for example, in Unexamined Japanese Patent Publication No. H06-346844. The compressor disclosed in this publication comprises a drive shaft to be rotated and a cylinder block arranged coaxially with the drive shaft and having a plurality of cylinder bores formed therein. The cylinder bores are arranged around the axis of the drive shaft at regular intervals and extend parallel with the axis of the drive shaft. A piston is fitted into each of the cylinder bores.

The compressor further comprises a rear case constituting a housing of the compressor in cooperation with the cylinder block and having a crank chamber defined therein. A swash plate is arranged in the crank chamber. The swash plate is coupled to the drive shaft at a predetermined angle to the axis of the drive shaft and is rotatable together with the drive shaft. The outer peripheral edge of the swash plate is engaged with each piston through a pair of shoes.

As the drive shaft is rotated together with the swash plate, rotation of the swash plate is converted to reciprocating motion of each piston through the shoes. In the case of the swash plate compressor, the reciprocating motion of the piston causes a suction process for sucking a fluid, that is, a refrigerant gas, into a pressure chamber defined in the cylinder bore, a compression process for compressing the refrigerant gas in the pressure chamber, and a discharge process for discharging the refrigerant gas from the pressure chamber.

The aforementioned pair of shoes is disposed such that the shoes merely slidably hold the outer peripheral edge of the swash plate therebetween, and accordingly, the piston can possibly rotate about an axis thereof within the cylinder bore.

To prevent such rotation, the piston disclosed in the abovementioned publication has a stopper surface. When the piston reciprocates, the stopper surface slides on the inner surface of the crank chamber in the reciprocating direction of the piston, to prevent rotation of the piston about its axis.

During operation of the compressor, the stopper surface of the piston is always brought into sliding contact with the inner surface of the crank chamber, and therefore, the sliding resistance of the piston, namely, the power consumption of the compressor, increases. Further, if excessive stress acts on the stopper surface or the supply of lubricating oil to the stopper surface is insufficient, adhesion or seizure of the stopper surface to the inner surface of the crank chamber may possibly be caused.

SUMMARY OF THE INVENTION

An object of the present invention is to provide a piston as well as a reciprocating machine using the piston, wherein the piston need not be provided with a stopper surface for sliding contact with the inner surface of a crank chamber and yet can be prevented from rotating about an axis thereof, thereby permitting reduction in power consumption of the reciprocating machine.

A reciprocating machine to which a piston according to the present invention is applied includes a cylinder bore for receiving the piston and a driving member for reciprocating the piston in the cylinder bore. The piston according to the present invention comprises: a piston body fitted into the cylinder bore and having a sliding peripheral surface disposed in sliding contact with an inner peripheral surface of the cylinder bore, the sliding peripheral surface of the piston body and the inner peripheral surface of the cylinder bore each having a noncircular cross-sectional form; and a coupler for coupling the piston body to the driving member.

According to the present invention, the piston is prevented from rotating about an axis thereof by the inner peripheral surface of the cylinder bore. Thus, the piston of the present invention does not require a stopper surface for preventing such rotation.

Specifically, the coupler of the piston is located within a noncircular imaginary tube which is generated by extending the sliding peripheral surface of the piston body along the axis of the piston. In this case, the coupler does not protrude to outside of the imaginary tube, and thus the coupler does not come into sliding contact with its surrounding members. During reciprocation of the piston, therefore, not only seizure or adhesion of the coupler is prevented but also the sliding resistance of the piston, that is, the motive power required to reciprocate the piston, can be reduced.

Preferably, the piston body comprises a hollow body having a head located on one side thereof opposite the coupler and having a circular open end located on the same side as the coupler, and the coupler has a circular end plate closing the open end of the piston body. Specifically, the end plate of the coupler is welded to the open end of the piston body in the axial direction of the piston. In this case, the piston is reduced in weight, permitting further reduction in the motive power necessary for reciprocating the piston.

The piston body preferably has at least one annular sealing member, and the sealing member forms the sliding peripheral surface of the piston body. The sealing member is attached to the piston body by being fitted in a peripheral groove of the piston body. Preferably, the sealing member is made of an elastically deformable material.

When the sealing member is fitted in the peripheral groove of the piston body, the sealing member is elastically deformed and then tightly fitted around the bottom of the peripheral groove.

The sealing member may have a noncircular external form similar to the cross-sectional form of the cylinder bore or a circular external form.

Also, to achieve the above object, the reciprocating machine of the present invention comprises: a cylinder block having a plurality of cylinder bores; a piston capable of reciprocating within a corresponding one of the cylinder bores and including a piston body fitted into the corresponding cylinder bore, the piston body having a sliding peripheral surface disposed in sliding contact with an inner peripheral surface of the cylinder bore, the sliding peripheral surface of the piston body and the inner peripheral surface of the cylinder bore each having a noncircular cross-sectional form; and a drive unit for sequentially reciprocating the pistons in the respective cylinder bores, the drive unit including a drive chamber which adjoins the cylinder block and which has an inner peripheral surface.

For example, the drive unit includes a rotary member rotatably arranged in the drive chamber and a converter for converting rotation of the rotary member to reciprocating motion of the piston associated therewith. Specifically, the converter has a tail extending from the piston body into the drive chamber, and a pair of shoes retained by the tail and slidably holding an outer peripheral edge of the rotary member therebetween.

The tail is located within a noncircular imaginary tube which is generated by extending the sliding peripheral surface of the piston body along an axis of the piston, to secure a predetermined gap between the tail and the inner peripheral surface of the drive chamber.

The reciprocating machine is, in this case, a compressor having a swash plate as the rotary member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENTS

Figure 1:
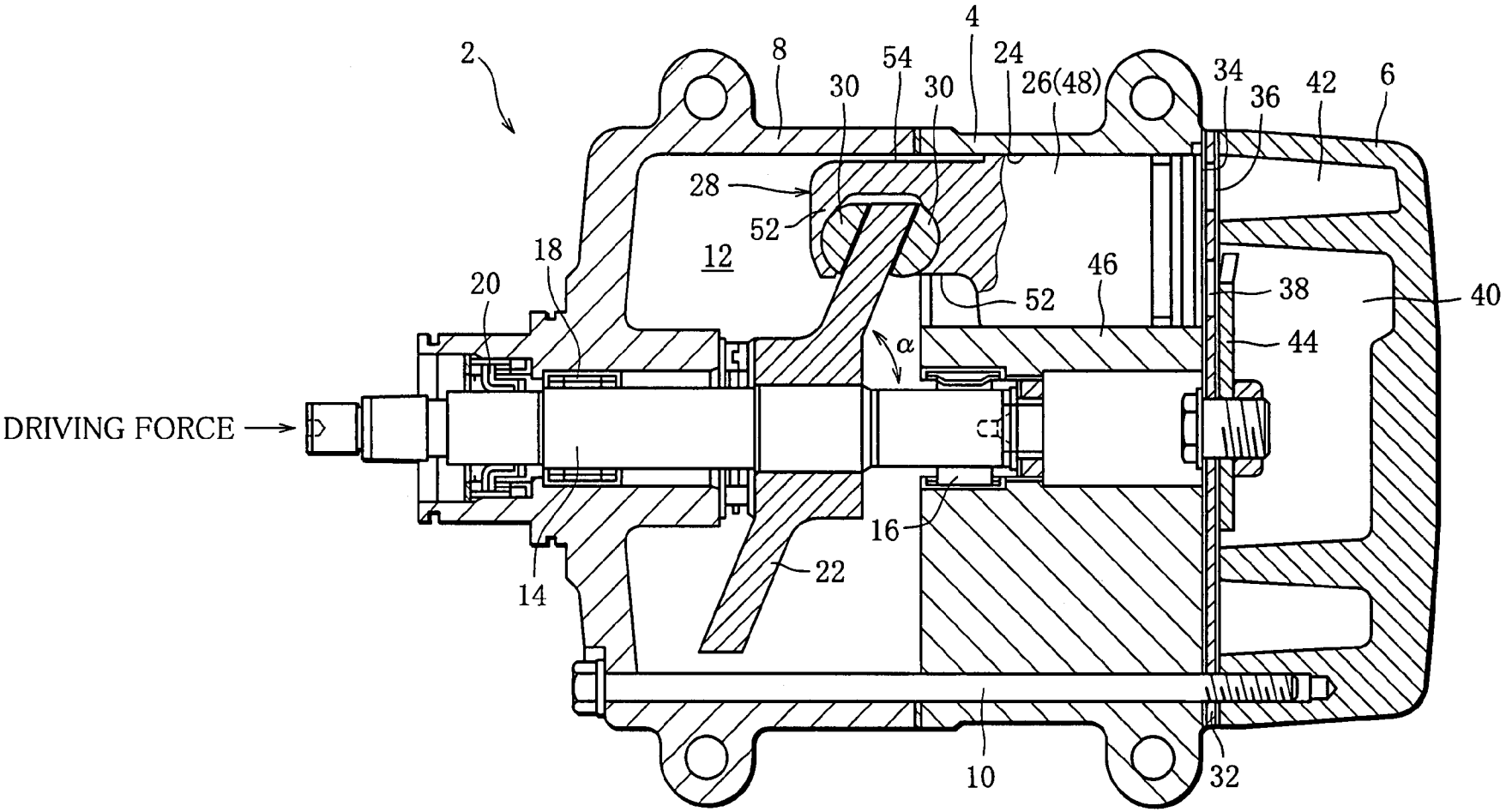
FIG. 1 is a longitudinal sectional view of a swash plate compressor.

A swash plate compressor shown in FIG. 1 is incorporated, for example, in a refrigeration circuit of an air conditioning system for an automotive vehicle and used for compressing a refrigerant in the refrigeration circuit. The refrigerant contains lubricating oil.

The compressor comprises a housing 2 which includes a cylinder block 4 located in the center and a cylinder head 6 and a rear case 8 arranged on opposite sides of the cylinder block 4, respectively. The cylinder block 4, the cylinder head 6 and the rear case 8 are combined into a one-piece body by a plurality of connecting bolts 10.

The rear case 8 has a crank chamber 12 defined therein and a drive shaft 14 extends through the crank chamber 12. The drive shaft 14 is arranged coaxially with the cylinder block 4 and has inner and outer ends. The inner end of the drive shaft 14 is supported by the cylinder block 4 through a bearing 16. The drive shaft 14 is also supported by the rear case 8 through a bearing 18, and the outer end thereof is extended to outside of the rear case 8 through a seal lip 20.

Driving force is transmitted to the outer end of the drive shaft 14. The driving force is produced by an engine (not shown) of the vehicle.

A swash plate 22 as a driving member is arranged in the crank chamber 12. The swash plate 22 is coupled to the drive shaft 14 and rotated together therewith. As is clear from FIG. 1, the swash plate 22 is inclined at a predetermined angle $\alpha$ to the axis of the drive shaft 14.

The cylinder block 4 has a plurality of cylinder bores 24 formed therein. The cylinder bores 24 are arranged at regular intervals in the circumferential direction of the cylinder block 4 and extend parallel with the axis of the drive shaft 14 through the cylinder block 4. A piston 26 is fitted into each of the cylinder bores 24 such that the pistons 26 are slidable in the respective cylinder bores 24.

Each piston 26 is connected to the swash plate 22 through a coupler. The coupler includes a tail 28 of the piston 26, and the tail 28 protrudes from the cylinder block 4 into the crank chamber 12. The tail 28 retains a pair of shoes 30, which in turn slidably hold the outer peripheral edge of the swash plate 22 therebetween. Thus, the pair of shoes 30 restricts only the movement of the outer peripheral edge of the swash plate 22 in the axial direction of the piston 26 and permits rotation of the swash plate 22.

A valve plate 32 is interposed between the cylinder block 4 and the cylinder head 6. The valve plate 32 closes the open ends of the cylinder bores 24 and defines pressure chambers 34 in the respective cylinder bores 24 in cooperation with the corresponding pistons 26. Also, the valve plate 32 has suction and discharge holes 36 and 38 associated with each of the cylinder bores 24. The discharge holes 38 are located inward of the suction holes 36 as viewed in the radial direction of the cylinder block 4.

In the cylinder head 6 are defined a discharge chamber 40 and an annular suction chamber 42 surrounding the discharge chamber 40. The discharge chamber 40 can communicate with the individual cylinder bores 24 through respective discharge valves and discharge holes 38, and the suction chamber 42 can communicate with the individual cylinder bores 24 through the respective suction holes 36 and suction valves. The discharge chamber 40 and the suction chamber 42 are connected to a condenser and evaporator, respectively, of the aforementioned refrigeration circuit.

Although not clearly shown in FIG. 1, the discharge and suction valves each comprise a reed valve and are arranged on opposite sides of the valve plate 32. The valve plate 32 further includes retainers 44 (only one retainer is shown in FIG. 1) associated with the respective discharge valves.

When the drive shaft 14 is rotated together with the swash plate 22, rotation of the swash plate 22 is converted to reciprocating motion of each piston 26 through the shoes 30 and the tail 28. Namely, the shoes 30 and the tail 28 constitute a converter for converting rotation of the swash plate 22 (drive shaft 14) to reciprocating motion of the corresponding piston 26.

As the piston 26 moves within the cylinder bore 24 toward the crank chamber 12, the volume of the pressure chamber 34 defined in the cylinder bore 24 increases. As a result, the refrigerant is sucked into the pressure chamber 34 from the suction chamber 42 through the suction hole 36 and the suction valve.

As the piston 26 moves thereafter toward the cylinder head 6, the refrigerant in the pressure chamber 34 is compressed, and the resulting high-pressure refrigerant is discharged to the discharge chamber 40 through the discharge hole 38 and the discharge valve.

Figure 2:
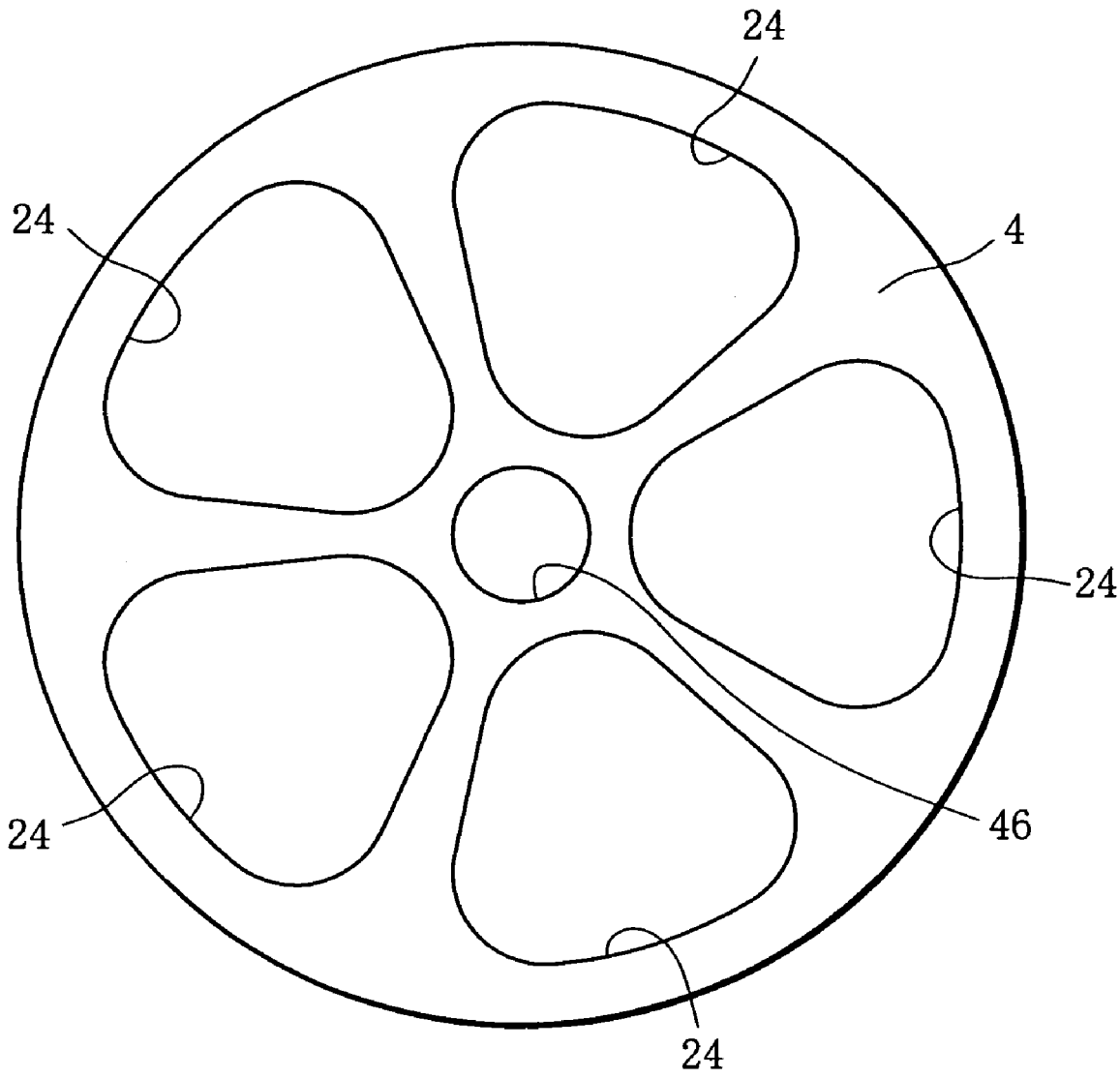
FIG. 2 illustrates an end face of a cylinder block appearing in FIG. 1.

As shown in FIG. 2, the cylinder block 4 has five cylinder bores 24 but may alternatively have seven cylinder bores 24. Each cylinder bore 24 has a noncircular cross-sectional form. In the case of the cylinder bores 24 shown in FIG. 2, the cross section of each cylinder bore is generally in the form of triangle, or more specifically, generally in the form of equilateral triangle of which all the vertexes are arcuately rounded.

Further, each cylinder bore 24 has a configuration such that one arcuate vertex thereof is directed toward the center of the cylinder block 4, that is, toward the axis of the drive shaft 14, while the remaining two arcuate vertexes are located apart from each other in the circumferential direction of the cylinder block 4. Arranging the cylinder bores 24 in this manner makes it possible to increase the number of cylinder bores that can be formed in the cylinder block 4, that is, the total cross-sectional area of the cylinder bores 24. Consequently, the compressor can be reduced in size while ensuring the same displacement.

The cylinder block 4 has a through hole 46 formed in the center thereof, and the inner end of the drive shaft 14 is inserted into the through hole 46 with the aforementioned bearing 16 therebetween.

Figure 3:
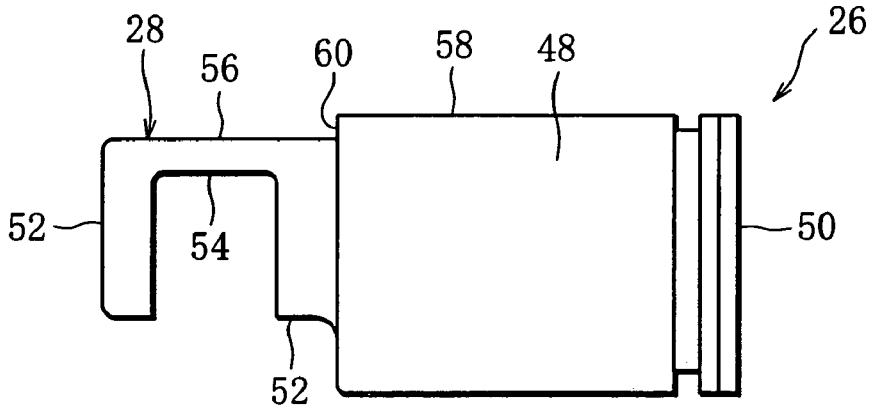
FIG. 3 is a side view of a piston according to a first embodiment, which is fitted into a cylinder bore shown in FIG. 1.
Figure 4:
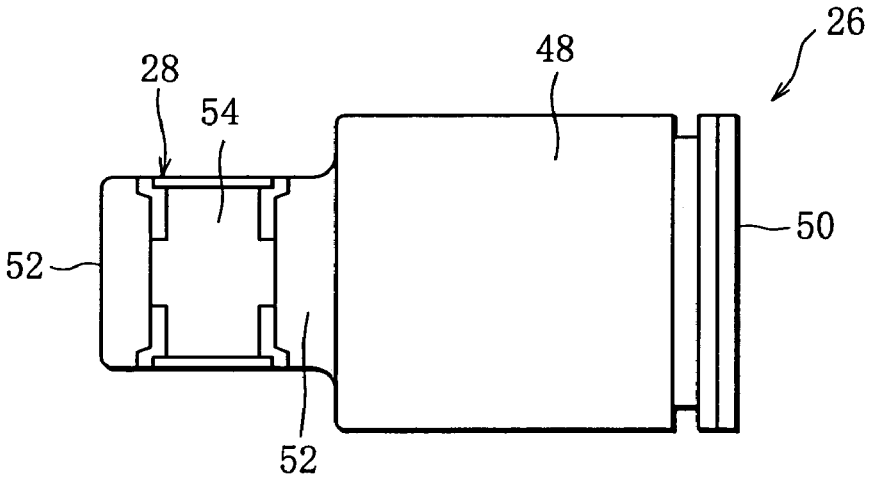
FIG. 4 illustrates the piston of FIG. 3 as viewed from the side of a drive shaft of the compressor of FIG. 1.
Figure 5:
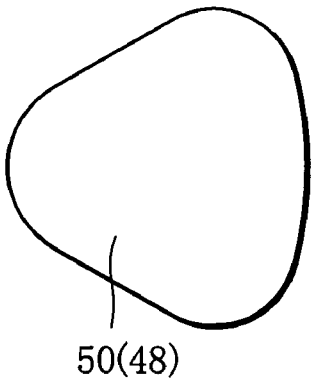
FIG. 5 illustrates a head face of the piston of FIG. 3.

FIGS. 3 to 5 show details of the piston 26 according to the first embodiment.

The piston 26 is made of aluminum or aluminum alloy and has a piston body 48 and the tail 28. The piston 26 is slidably fitted at the piston body 48 into the cylinder bore 24, and a front end of the piston body 48 is formed as a head 50 for defining the pressure chamber 34.

The tail 28 protrudes integrally from a rear end of the piston body 48, and with the piston body 48 fitted into the cylinder bore 24, the tail 28 defines a U-shaped recess as viewed in longitudinal section of the piston body 48. As is clear from FIGS. 3 and 4, the recess is open in both the circumferential and radial directions of the cylinder block 4 so as to allow passage of the outer peripheral edge of the swash plate 22.

More specifically, the tail 28 has a pair of shoe retainers 52 spaced from each other in the axial direction of the piston body 48. One shoe retainer 52 is coupled to the rear end of the piston body 48 and also coupled to the other shoe retainer 52 through a bridge 54. When the piston 26 is received in the cylinder bore 24, the bridge 54 is located radially outward toward the outer peripheral surface of the cylinder block 4. The shoe retainers 52 have inner surfaces facing each other, and the aforementioned shoes 30 are retained by the respective inner surfaces.

The piston body 48 has a cross-sectional form coincident with that of the cylinder bore 24. Namely, the cross section of the piston body 48 is generally in the form of equilateral triangle, as shown in FIG. 5, of which all the vertexes are arcuately rounded.

The tail 28 has an arcuate outer peripheral surface 56 formed on the bridge 54 and extending from the rear end of the piston body 48 in the axial direction of same. As clearly shown in FIG. 3, a riser 60 is formed at the boundary between the outer peripheral surface 56 of the tail 28 and an outer peripheral surface 58 of the piston body 48. The riser 60 faces in a direction opposite to the piston body 48. Namely, the outer peripheral surface 56 of the tail 28 is located inward of the outer peripheral surface 58 of the piston body 48 as viewed in the radial direction of the piston body 48.

In other words, where an imaginary tube is considered which is generated by extending toward the tail 28 the outer peripheral surface 58 of the piston body 48, that is, the sliding peripheral surface of the piston body 48 disposed in sliding contact with the inner peripheral surface of the cylinder bore 24, the outer peripheral surface 56 of the tail 28 is located within the imaginary tube. Consequently, a predetermined gap is always secured between the outer peripheral surface 56 of the tail 28 and the inner surface of the crank chamber 12, as clearly shown in FIG. 1, so that the tail 28 never comes into sliding contact with the inner surface of the crank chamber 12 during reciprocation of the piston 26.

In the swash plate compressor described above, the piston body 48 of the piston 26 has a noncircular cross-sectional form, and accordingly, the piston 26 never rotates about the axis thereof inside the cylinder bore 24. Namely, the piston body 48 of the piston 26 itself functions as a stopper for preventing the piston from rotating on its axis.

Also, since the tail 28 of the piston 26 does not come into sliding contact with the inner peripheral surface of the crank chamber 12, the sliding resistance of the piston 26 decreases, permitting the compressor to operate with less power consumed. Further, adhesion or seizure of the outer peripheral surface 56 of the tail 28 to the inner surface of the crank chamber 12 does not occur.

The cross-sectional form of the piston body 48 is not limited to generally equilateral triangular form shown in FIG. 5 and may be any one of various forms shown in FIGS. 6 to 10.

In FIGS. 6 to 10, each arrow indicates the side on which the center of the cylinder block 4 is located when the piston body 48 is fitted into the cylinder bore 24.

Figure 6:
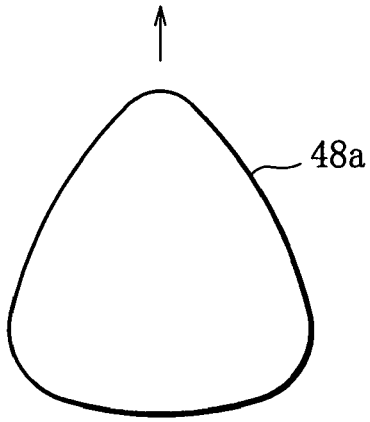
FIGS. 6 to 10 respectively illustrate cross-sectional forms of pistons different from the cross-sectional form of the piston of FIG. 3.

The cross section of a piston body 48*a* shown in FIG. 6 is generally in the form of isosceles triangle whose sides and vertexes are arcuately rounded so as to smoothly connect with one another. With the piston body 48*a*, it is possible to increase the occupation ratio of the piston body, that is, the area which all of the piston bodies 48*a* occupy in the cross section of the cylinder block 4, like the piston body 48 shown in FIG. 5. Accordingly, the compressor can be reduced in size while maintaining the same displacement.

Figure 7:
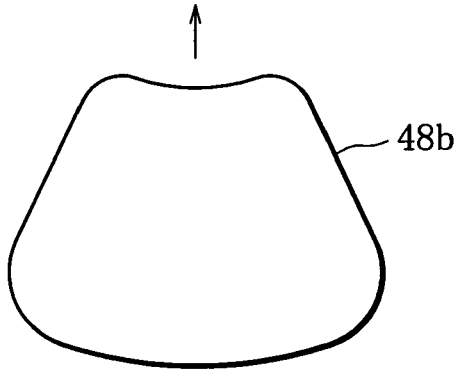

The cross section of a piston body 48*b* shown in FIG. 7 is generally in the form of trapezoid whose bases and four angles are arcuately rounded. Where the number of pistons 26 is the same, the area occupied by all of the piston bodies 48*b* is greater than that occupied by all of the piston bodies

48*a* (the occupation ratio of the former is greater than that of the latter), thus permitting further reduction in size of the compressor.

Figure 8:
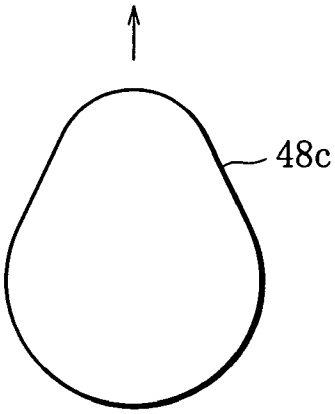

A piston body 48*c* shown in FIG. 8 has a cross-sectional form obtained by connecting two facing arcs with different radii of curvature smoothly by two straight lines. The cross section of a piston body 48*d* shown in FIG. 9 and the cross section of a piston body 48*e* shown in FIG. 10 are each in the form of ellipse.

Figure 9:
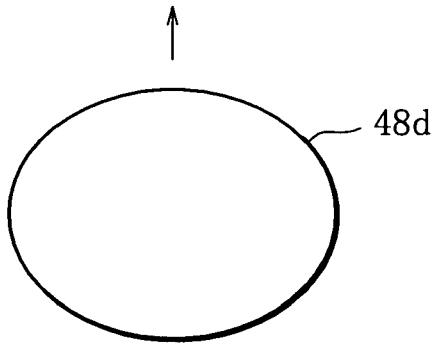
Figure 10:
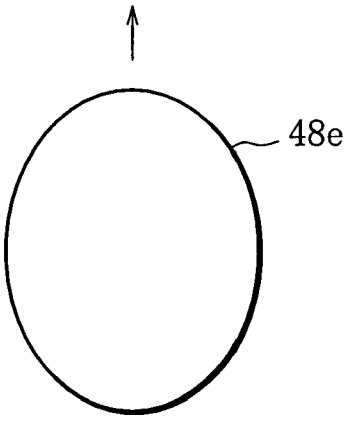

The piston bodies 48*c* to 48*e* shown in FIGS. 8 to 10 are easier to produce than the piston bodies 48*a* and 48*b* shown in FIGS. 6 and 7.

The piston of the present invention is not limited to the first embodiment or modifications described above. The following describes other embodiments and modifications. In the following description of the other embodiments and modifications, identical reference numerals are used to denote elements and parts having the same functions as those of the piston 26 of the first embodiment, and description of such elements and parts is omitted.

Figure 11:
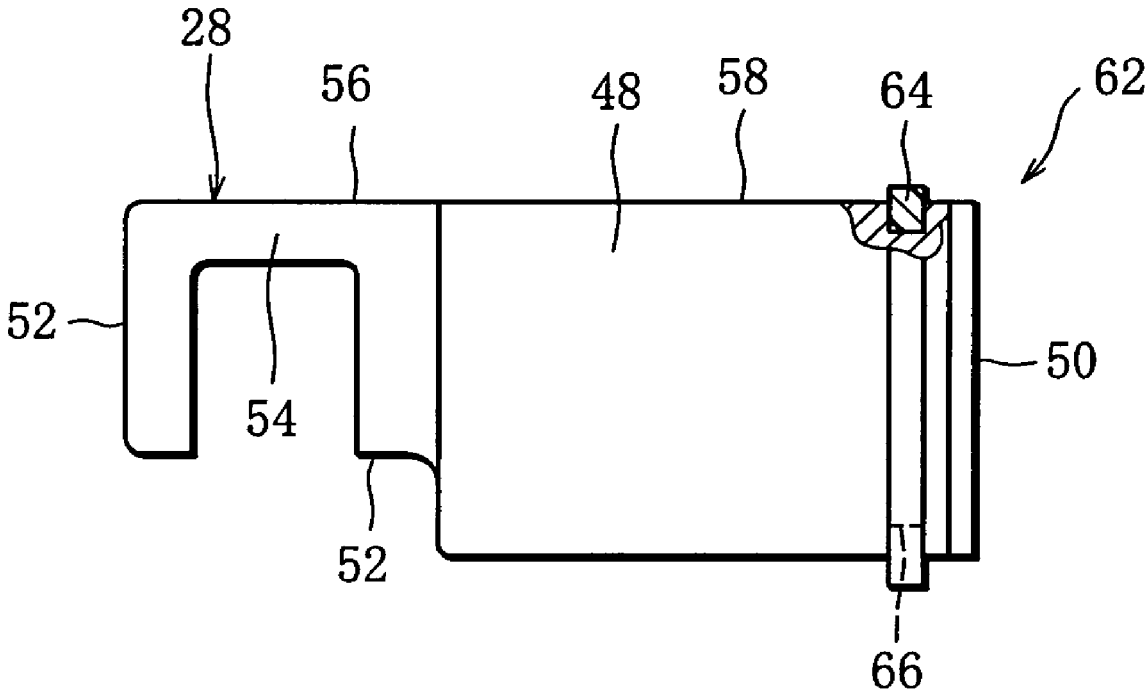
FIG. 11 is a side view of a piston according to a second embodiment.
Figure 12:
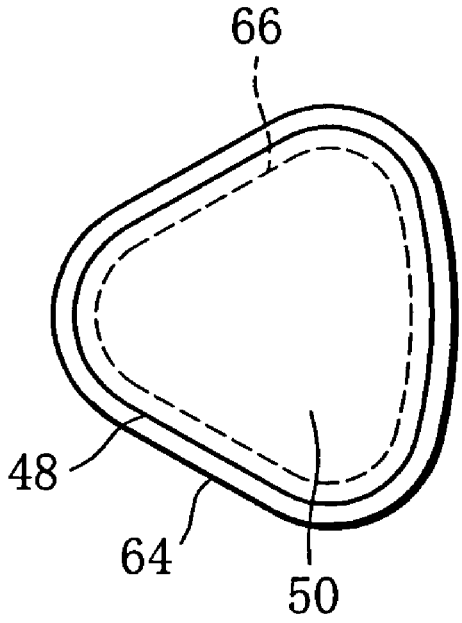
FIG. 12 illustrates a head of the piston of FIG. 11.

FIGS. 11 and 12 show a piston 62 according to a second embodiment.

The piston 62 has at least one sealing member, or a sealing ring 64, in place of the aforementioned riser 60, and the sealing ring 64 is fitted around the outer peripheral surface 58 of the piston body 48. More specifically, the sealing ring 64 has a shape similar to the cross-sectional form of the piston body 48 and is made of an elastically deformable material such as PTFE (polytetrafluoroethylene) resin. A peripheral groove 66 is cut in the outer peripheral surface of the piston body 48 at a location near the head 50 of the piston body 48. The sealing ring 64 is fitted in the peripheral groove 66 and slightly protrudes from the outer peripheral surface of the piston body 48. In this arrangement, the sliding peripheral surface of the piston 62 disposed in sliding contact with the inner peripheral surface of the cylinder bore 24 is constituted not by the outer peripheral surface 58 of the piston body 48, but by the outer peripheral surface of the sealing ring 64.

With the piston 62 of the second embodiment, the pressure chamber 34 can be effectively sealed by the sealing ring 64. It is therefore possible to reduce the amount of refrigerant flowing out into the crank chamber 12 from the pressure chamber 34, that is, the amount of lubricating oil flowing out together with the refrigerant, as well as to improve the volumetric efficiency of the compressor.

In the case of the piston 62 of the second embodiment, the outer peripheral surface 58 of the piston body 48 is not brought into sliding contact with the inner peripheral surface of the cylinder bore 24, and accordingly, seizure of the outer peripheral surface 58 does not occur. Also, the outer peripheral surface 58 of the piston body 48 does not require grinding finish, and thus the production cost of the piston 62 can be reduced.

Figure 13:
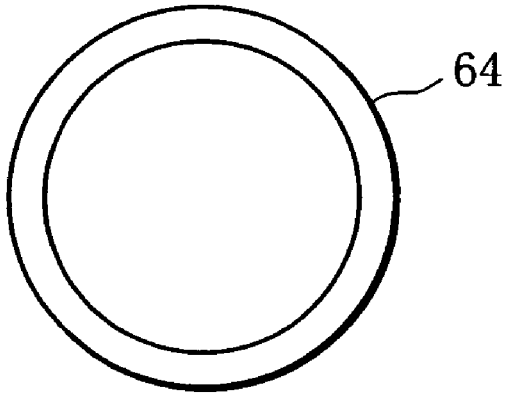
FIG. 13 illustrates a modification of a sealing ring.
Figure 14:
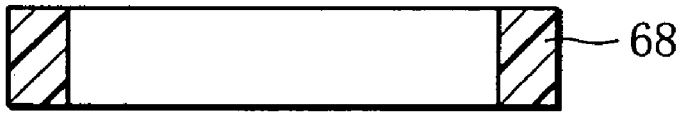
FIG. 14 is a sectional view of a sealing sleeve.
Figure 15:
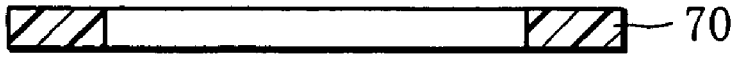
FIG. 15 is a sectional view of a sealing disc.

The sealing ring 64 is elastically deformable, and therefore, the shape thereof need not be similar to the cross-sectional form of the piston body 48 and may be circular, as shown in FIG. 13. In this case, the sealing ring 64 takes the form of a sealing sleeve 68 shown in FIG. 14 or a sealing disc 70 shown in FIG. 15.

The sealing sleeve 68 or the sealing disc 70 having such a circular shape needs to be elastically deformed so as to be fitted in the peripheral groove 66 of the piston body 48. However, since the sleeve 68 or the disc 70 can be elastically deformed with ease, it is easy to fit the sleeve 68 or the disc 70 in the peripheral groove 66.

Specifically, when the sealing sleeve 68 or the sealing disc 70 is in a free state, the length of the inner circumference thereof is 10 to 30% shorter than the circumferential length of the bottom of the peripheral groove 66. When the sealing sleeve 68 or the sealing disc 70 is fitted in the peripheral groove 66, therefore, the inner circumference of the sealing sleeve 68 or sealing disc 70 is extended by 10 to 30%, so that the sealing sleeve or disc tightly fits around the bottom of the peripheral groove 66.

In the case of using the sealing ring 64 with a shape similar to the cross-sectional form of the piston body 48, the distance by which the sealing ring 64 protrudes from the outer peripheral surface 58 of the piston body 48 can relatively easily be made uniform along the circumferential direction of the piston body 48, whereby the clearance between the inner peripheral surface of the cylinder bore 24 and the outer peripheral surface of the sealing ring 64 can be made nearly uniform along the circumferential direction of the cylinder bore 24.

Figure 16:
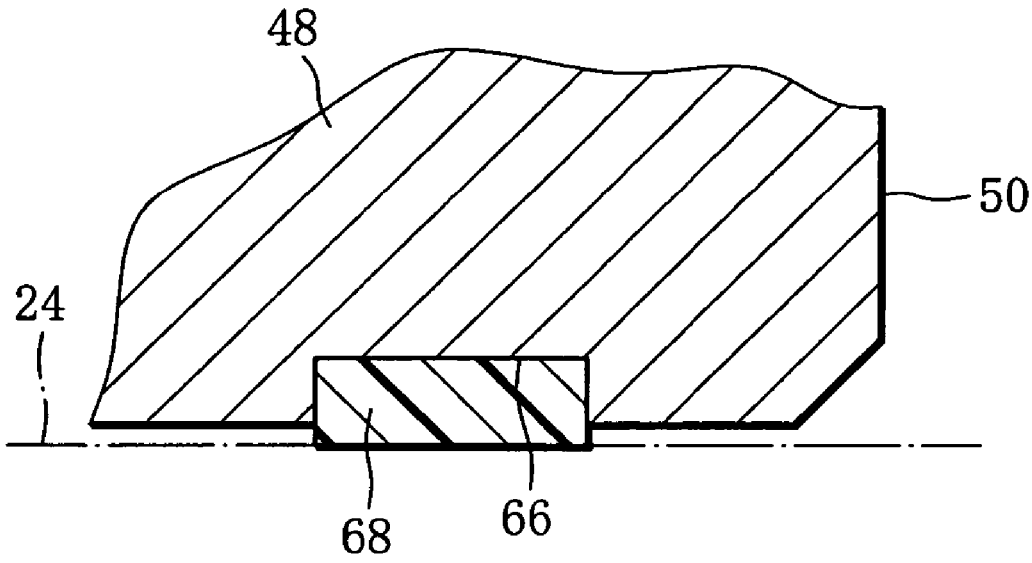
FIG. 16 is a sectional view showing the sealing sleeve attached to a piston body.

The sealing ring 64, the sealing sleeve 68 or the sealing disc 70 is preferably fitted in close contact with the peripheral groove 66 (cf. FIG. 16).

FIG. 16 exemplifies the case of using the sealing sleeve 68. The depth of the peripheral groove 66 is slightly smaller than the radial thickness of the sealing ring 64, sealing sleeve 68 or sealing disc 70, and thus the ring 64, the sleeve 68 or the disc 70 protrudes slightly from the outer peripheral surface 58 of the piston body 48.

Because of the circular shape, the sealing sleeve 68 and the sealing disc 70 are easier to produce than the sealing ring 64.

Also, compared with the sealing sleeve 68, the sealing ring 64 and the sealing disc 70 can be easily fitted in the peripheral groove 66.

Figure 17:
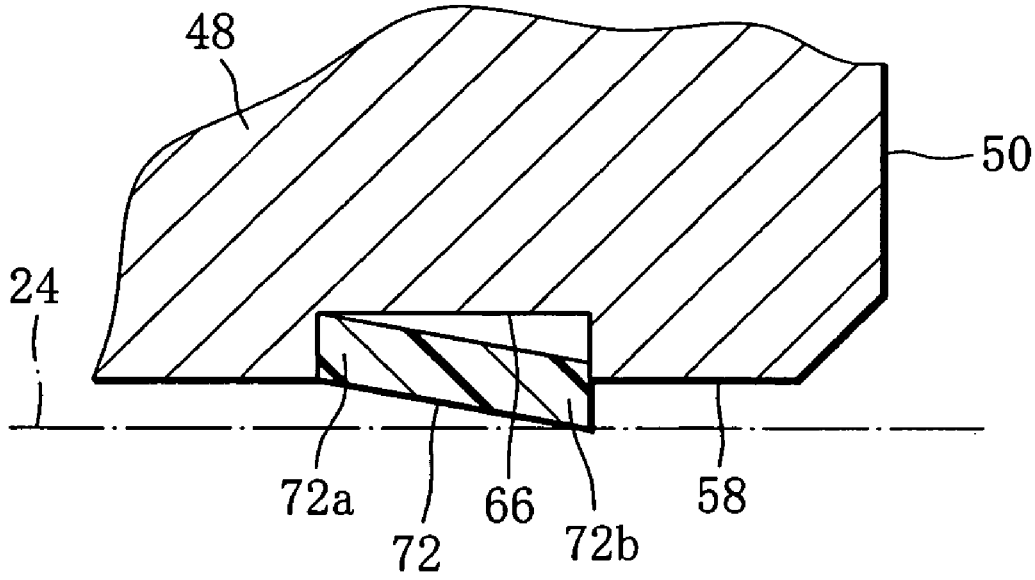
FIG. 17 is a sectional view showing a tapered sealing sleeve.
Figure 18:
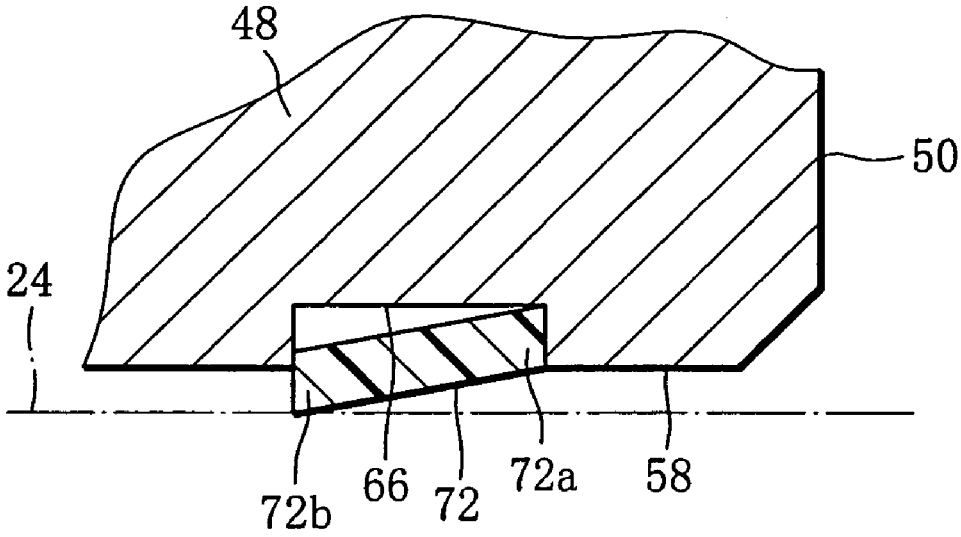
FIG. 18 is a sectional view also showing the tapered sealing sleeve.

The sealing sleeve 68 is replaceable by a tapered sealing sleeve 72 shown in FIG. 17 or 18. The sealing sleeve 72 of FIG. 17 has a small-diameter end 72*a* located on the same side as the tail 28 of the piston 62 and a large-diameter end 72*b* located on the same side as the head 50 of the piston 62. When fitted in the peripheral groove 66, the small-diameter end 72*a* is pressed against the bottom of the peripheral groove 66 while the large-diameter end 72*b* protrudes from the outer peripheral surface 58 of the piston body 48.

The sealing sleeve 72 shown in FIG. 18 is fitted in the peripheral groove 66 with its sides facing in directions opposite to those of the sealing sleeve 72 of FIG. 17. Namely, the small-diameter end 72*a* is located on the same side as the head 50 of the piston 62 and the large-diameter end 72*b* is located on the same side as the tail 28 of the piston 62.

Figure 19:
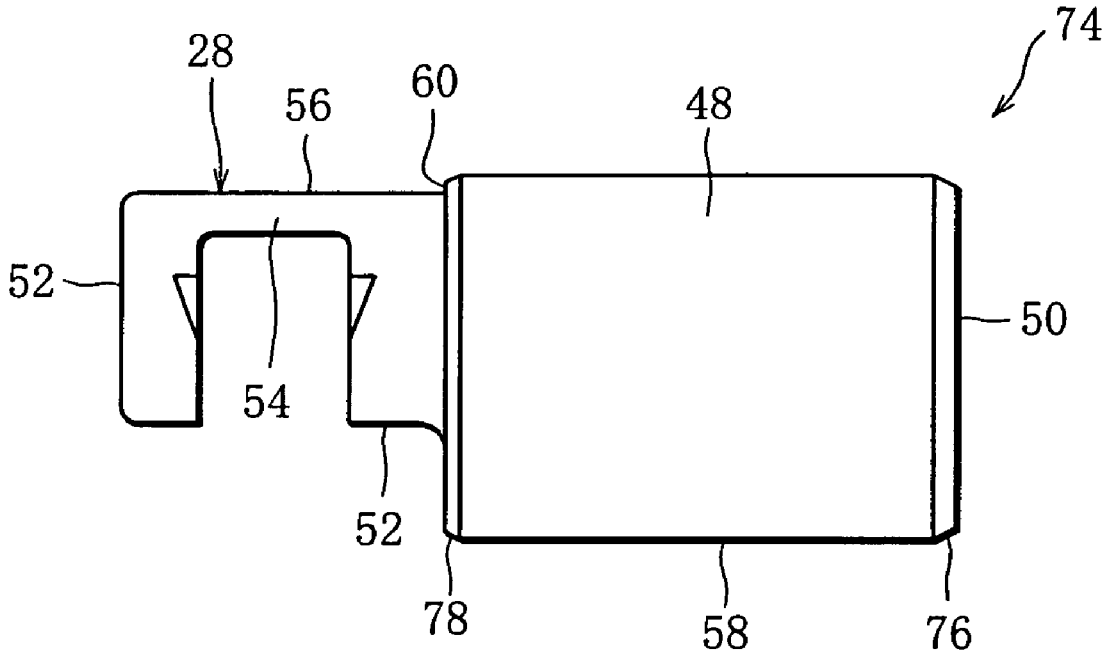
FIGS. 19 to 21 illustrate a piston according to a third embodiment.
Figure 20:
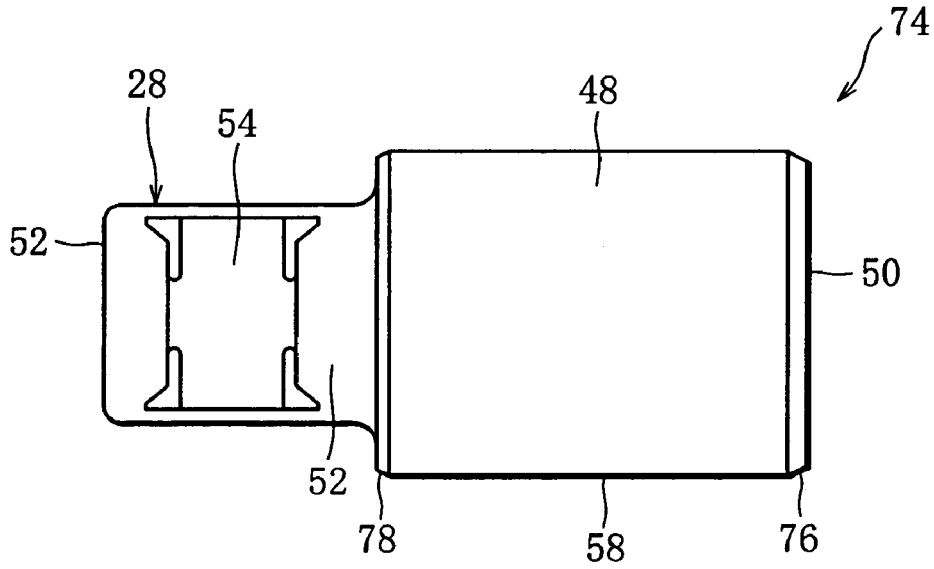
Figure 21:
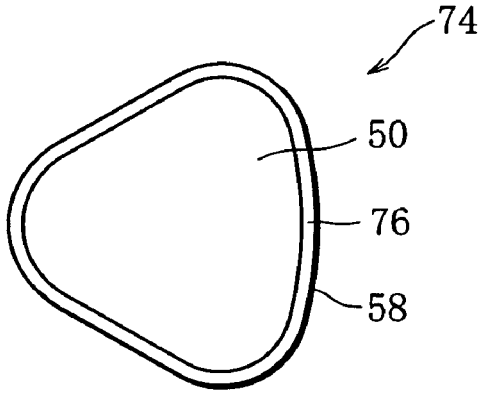

FIGS. 19 to 21 illustrate a piston 74 according to a third embodiment.

The piston 74 has a riser 60, like the piston 26 of the first embodiment, and accordingly, the outer peripheral surface of the tail 28 of the piston 74 does not come into sliding contact with the inner peripheral surface of the crank chamber 12.

The piston body 48 of the piston 74 has a tapered surface 76 formed at the outer peripheral edge of the head 50. Also, a tapered surface 78 is formed at the boundary between the piston body 48 and the tail 28, inclusive of the riser 60. The tapered surface 78 faces in a direction opposite to that of the tapered surface 76.

Figure 22:
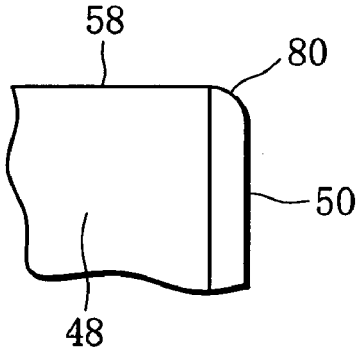
FIGS. 22 and 23 each illustrate a part of the piston of FIG. 19.
Figure 23:
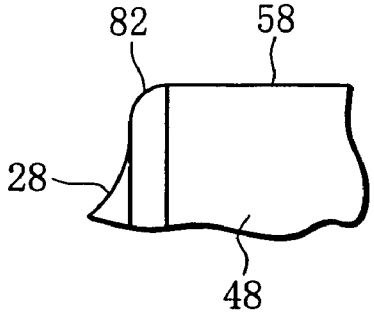

The tapered surfaces 76 and 78 may be replaced by arcuate surfaces 80 and 82 shown in FIGS. 22 and 23, respectively, or by crowned surfaces (not shown).

Figure 24:
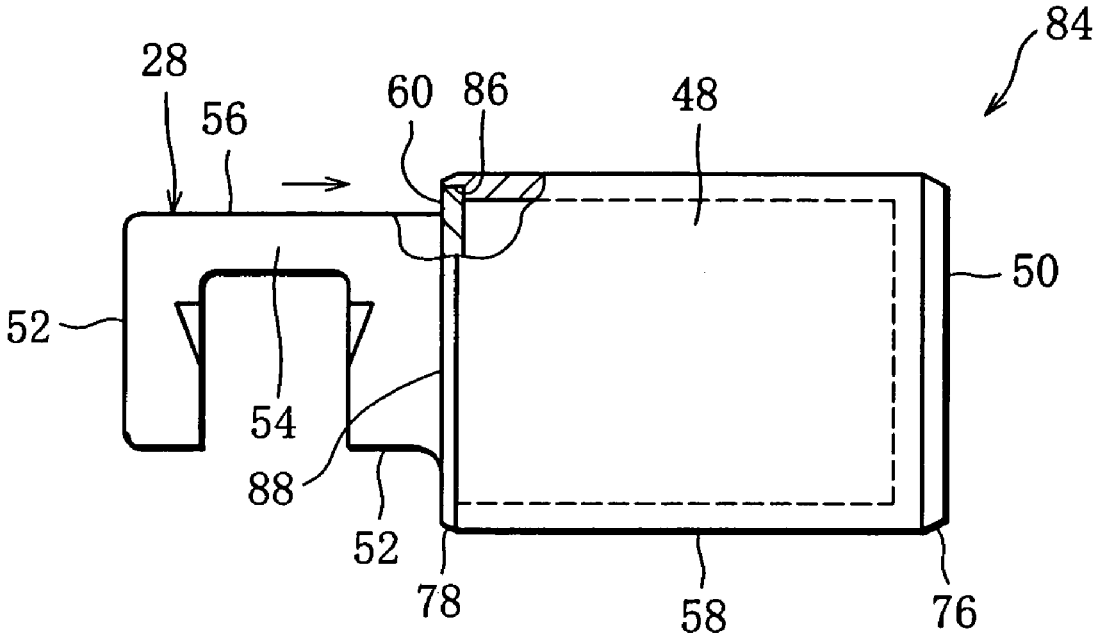
FIGS. 24 and 25 illustrate a piston according to a fourth embodiment.
Figure 25:
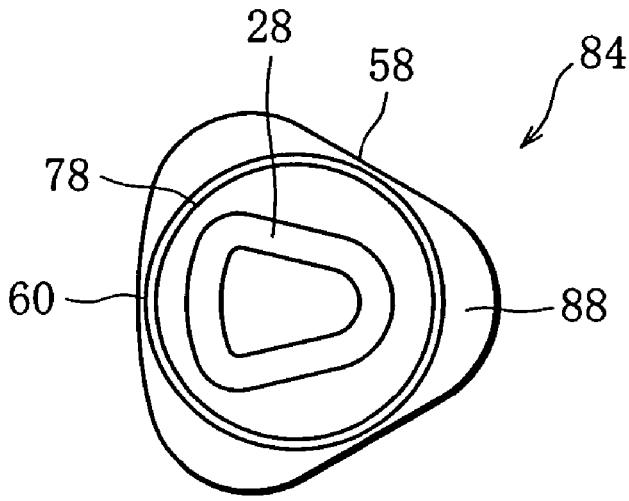

FIGS. 24 and 25 illustrate a piston 84 according to a fourth embodiment.

The piston 84 has a riser 60, like the piston 26 of the first embodiment, and also has tapered surfaces 76 and 78, like the piston 74 of the third embodiment.

The piston 84 has a hollow piston body 48 opening at one end thereof close to the tail 28. The open end of the piston body 48 has a circular recess 86 formed in an inner peripheral surface thereof.

On the other hand, the tail 28 has a circular end plate 88 as an integral part thereof, and the end plate 88 is fitted in the recess 86 of the piston body 48. The outer peripheral edge of the end plate 88 is welded to the recess 86 of the piston body 48, thereby joining the tail 28 to the piston body 48 through the end plate 88. In FIG. 24, the arrow indicates the direction of welding the end plate 88. Unlike the piston body 48, the end plate 88 is circular in shape, and accordingly, the weld length for the end plate 88 is short, making it possible to lessen the influence of heat on the piston 84.

The pistons described above are equally suitable as pistons for a swash plate compressor. It is to be noted, however, that the application of the piston of the present invention is not limited to swash plate compressor alone, and the piston can be used in a variety of reciprocating machines.

Also, the swash plate compressor shown in FIG. 1 is of a fixed displacement type, but the piston of the present invention is equally applicable to compressors of variable displacement type. When applied to a variable displacement-type compressor, the piston of the present invention serves to substantially improve the displacement control characteristic of the compressor.

What is claimed is:

1. A piston for a reciprocating machine including a cylinder bore for receiving said piston and a driving member for reciprocating said piston in the cylinder bore, said piston comprising:

a piston body fitted into the cylinder bore and having a sliding peripheral surface disposed in sliding contact with an inner peripheral surface of the cylinder bore, the sliding peripheral surface of said piston body and the inner peripheral surface of the cylinder bore each having a noncircular cross-sectional form;

a tapered sealing sleeve fitted in a peripheral groove of the piston body, wherein the sleeve has a first-diameter end located on the same side as a tail of the piston body and a second-diameter end located on the same side as a head of the piston body, the first-diameter is not equal to the second-diameter; and a coupler for coupling said piston body to the driving member.

2. The piston according to claim 1, wherein said coupler is located within a noncircular imaginary tube which is generated by extending the sliding peripheral surface of said piston body along an axis of said piston.

3. The piston according to claim 2, wherein said sealing sleeve is made of an elastically deformable material.

4. The piston according to claim 3, wherein said sealing member has a noncircular external form similar to the cross-sectional form of the cylinder bore.

5. A piston for a reciprocating machine including a cylinder bore for receiving said piston and a driving member for reciprocating said piston in the cylinder bore, said piston comprising:

a piston body fitted into the cylinder bore and having a sliding peripheral surface disposed in sliding contact with an inner peripheral surface of the cylinder bore, the sliding peripheral surface of said piston body and the inner peripheral surface of the cylinder bore each having a noncircular cross-sectional form;

a coupler for coupling said piston body to the driving member, wherein said coupler is located within a noncircular imaginary tube which is generated by extending the sliding peripheral surface of said piston body along an axis of said piston; and a hollow body having a head located on one side thereof opposite said coupler and having a circular open end located on the same side as said coupler, and said coupler has a circular end plate closing the open end of said piston body.

6. The piston according to claim 5, wherein the end plate of said coupler is welded to the open end of said piston body in the axial direction of said piston.

7. A piston for a reciprocating machine including a cylinder bore for receiving said piston and a driving member for reciprocating said piston in the cylinder bore, said piston comprising:

a piston body fitted into the cylinder bore and having a sliding peripheral surface disposed in sliding contact with an inner peripheral surface of the cylinder bore, the sliding peripheral surface of said piston body and the inner peripheral surface of the cylinder bore each having a noncircular cross-sectional form, wherein said piston body comprises:

at least one annular sealing member, the sealing member forming the sliding peripheral surface of said piston body; and a peripheral groove for receiving the sealing member, wherein said sealing member is made of an elastically deformable material and when said sealing member is in a free state, said sealing member has an inner circumferential length 10 to 30% shorter than a circumferential length of a bottom of the peripheral groove, and said sealing member is fitted in the peripheral groove while being elastically deformed; and a coupler for coupling said piston body to the driving member, wherein said coupler is located within a noncircular imaginary tube which is generated by extending the sliding peripheral surface of said piston body along an axis of said piston.

8. A piston for a reciprocating machine including a cylinder bore for receiving said piston and a driving member for reciprocating said piston in the cylinder bore, said piston comprising:

a piston body fitted into the cylinder bore and having a sliding peripheral surface disposed in sliding contact with an inner peripheral surface of the cylinder bore, the sliding peripheral surface of said piston body and the inner peripheral surface of the cylinder bore each having a noncircular cross-sectional form, wherein said piston body comprises:

at least one annular sealing member, the sealing member forming the sliding peripheral surface of said piston body; and a peripheral groove for receiving the sealing member, wherein said sealing member is made of an elastically deformable material and has a circular external form; and a coupler for coupling said piston body to the driving member, wherein said coupler is located within a noncircular imaginary tube which is generated by extending the sliding peripheral surface of said piston body along an axis of said piston.

9. A piston for a reciprocating machine including a cylinder bore for receiving said piston and a driving member for reciprocating said piston in the cylinder bore, said piston comprising:

a piston body fitted into the cylinder bore and having a sliding peripheral surface disposed in sliding contact with an inner peripheral surface of the cylinder bore, the sliding peripheral surface of said piston body and the inner peripheral surface of the cylinder bore each having a noncircular cross-sectional form, wherein said piston body has at least one of arcuated outer peripheral edge, tapered outer peripheral edge or crowned outer peripheral edge formed at each of opposite ends thereof; and a coupler for coupling said piston body to the driving member.

* * * * *